United States Patent [19]

Bubley et al.

[11] 4,434,562

[45] Mar. 6, 1984

[54] CURING APPARATUS AND METHOD

[75] Inventors: Henry J. Bubley, Deerfield; Gene M. Faulkner, Palatine; Alex Iaccino, Mt. Prospect; Giuseppe Rescio, Berwyn, all of Ill.

[73] Assignee: American Screen Printing Equipment Company, Chicago, Ill.

[21] Appl. No.: 298,575

[22] Filed: Sep. 2, 1981

[51] Int. Cl.[3] ..... F26B 3/28

[52] U.S. Cl. ..... 34/4; 34/41; 422/186; 204/158 R

[58] Field of Search ..... 204/158, 159.11; 34/4, 34/41; 422/186

[56] References Cited

U.S. PATENT DOCUMENTS

| | | | |
|---|---|---|---|
| 3,831,289 | 8/1974 | Knight | 34/4 |
| 3,950,650 | 4/1976 | Pray et al. | 34/4 |
| 3,991,484 | 11/1976 | Lamb et al. | 34/4 |
| 4,005,135 | 1/1977 | Helding | 422/186.3 |
| 4,015,340 | 4/1977 | Treleven | 34/41 |
| 4,143,278 | 3/1979 | Koch | 34/41 |

FOREIGN PATENT DOCUMENTS

| | | | |
|---|---|---|---|
| 2460706 | 1/1976 | Fed. Rep. of Germany | 34/4 |

*Primary Examiner*—R. L. Andrews
*Assistant Examiner*—Terryence Chapman
*Attorney, Agent, or Firm*—Fitch, Even, Tabin & Flannery

[57] ABSTRACT

A curing unit includes an arcuate reflector shield open at the lower end with a curing lamp in the shield and a cooling chamber above the shield. Cooling fluid is directed into the chamber toward the outer surface of the shield and some of this cooling fluid is also directed along the inner surface. Light trap are located adjacent the leading and trailing edges of the unit above an article conveyor belt and a vacuum chamber is located below the belt to draw ozone generated by the unit, as well as hold the article on the belt.

11 Claims, 2 Drawing Figures

CURING APPARATUS AND METHOD

DESCRIPTION

1. Technical Field

The present invention relates generally to curing apparatus for use in screen printing and, more particularly, to an apparatus for curing photopolymerizable inks applied to flat and three-dimensional articles.

2. Background Prior Art

The use of ultraviolet light sources for curing screen printed articles has been known for some time. However, one of the shortcomings of the prior art systems is the fact that such systems develop an excessive amount of heat. Thus, prior art types of ultraviolet curing systems have required a large housing to store the ultraviolet light source in a condition to dissipate the heat from the system and also for the dissipation of ozone generated by the ultraviolet light source.

An article appearing in the January, 1981 issue of Screen Printing entitled "UV Update" by Harden H. Troue, summarizes the status of the existing ultrviolet equipment and processing as applied to graphic arts screen printing. This article is incorporated herein by reference.

To date, no acceptable system has been developed which is capable of being housed in a confined space and still maintain an efficient cooling system at high electromagnetic energy levels.

SUMMARY OF THE INVENTION

According to the present invention, an ultraviolet curing apparatus has been developed which can be housed in a confined space and incorporates a unique air cooling system as well as an ultraviolet light trap.

The curing unit of the present invention includes an elongated curing lamp with a reflector shield partially surrounding the lamp and terminating along opposite lateral edges between opposite ends with the inner surface of the shield spaced from the lamp. Cooling means are incorporated into the unit and include a blower for producing cooling fluid directed toward the outside surface of the reflector shield with deflector means for directing at least some of the cooling fluid along the inner surface of the reflector shield to cool such surface.

More specifically, the curing unit includes a housing which surrounds at least a portion of the reflector shield and cooperates therewith to define an elongated chamber into which the cooling fluid is directed. Elongated slots are formed between the outer surface of the reflector shield and the housing to produce outlets for the cooling fluid. The deflector means is in the form of an extension extending from one edge of the housing downwardly and around one lateral edge of the reflector shield so that the cooling fluid flowing through the adjacent slot is directed along the inner surface of the reflector shield.

The air and reflector design are such that at least some of the cooling air flows over the inner surface of the reflector and then downwardly towards an object that is being cured. The reflector design is such that no ultraviolet energy impinges upon the metallic supporting structure surrounding the reflector. Thus, all of the energy is reflected downwards towards the object that is being cured.

According to another aspect of the invention, the article that is being cured is supported on an endless conveyor belt that moves the article below the curing unit and a vacuum chamber is located below the conveyor to draw in any ozone generated by the ultraviolet unit and, at the same time, holds the article securely on the conveyor while it is passing through the curing unit.

According to another aspect of the invention, baffle means extend from the leading and trailing sides of the curing unit, particularly the housing, to insure that all of the ultraviolet energy is maintained within the unit. The baffle means may be considered a light trap at the exit and entrance to the curing unit and consist of a chevron-type material which will not allow any light to pass directly through the material while yet allowing the flow of air therethrough.

DESCRIPTION OF SEVERAL VIEWS OF DRAWINGS

FIG. 1 is a perspective view of the curing apparatus constructed in accordance with the present invention; and FIG. 2 is a cross-sectional view as generally viewed along line 2—2 of FIG. 1.

DETAILED DESCRIPTION

Figure 1:
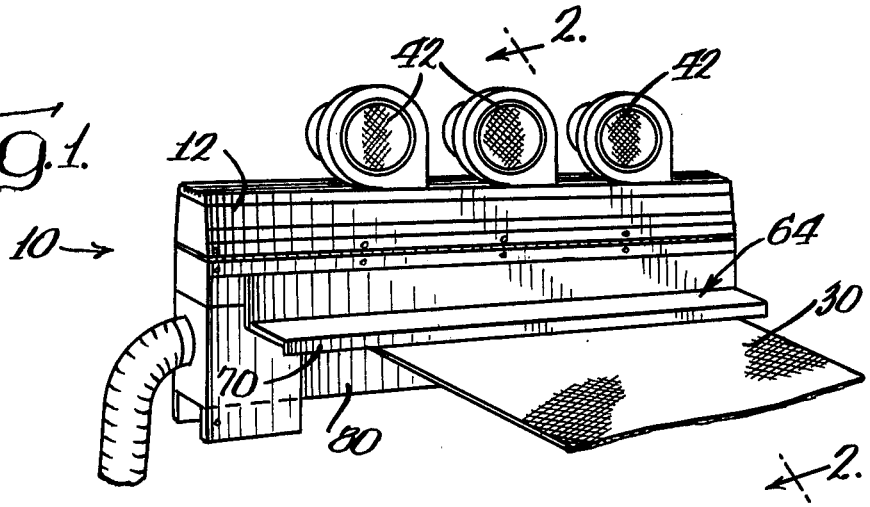

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Figure 2:
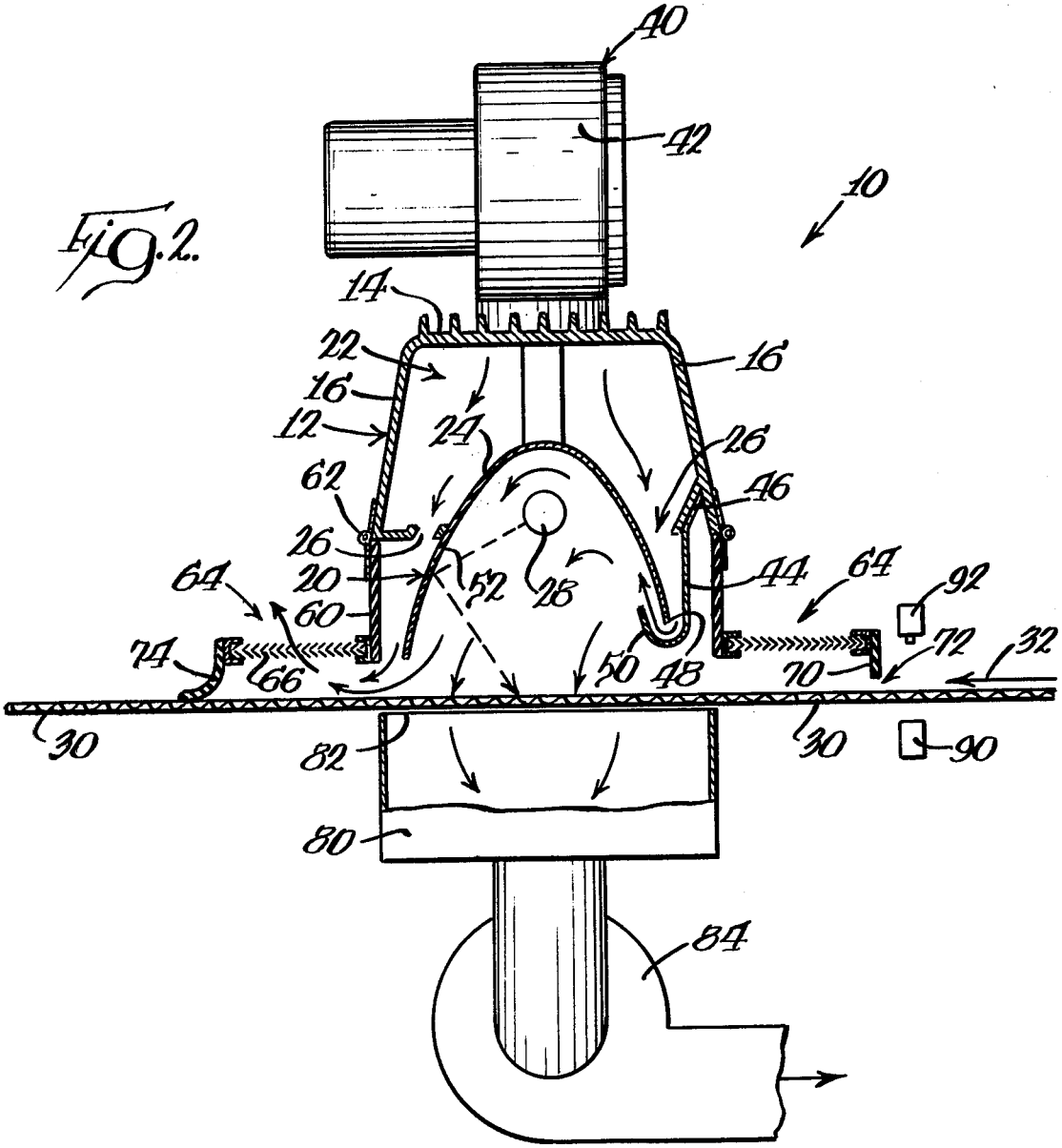

FIGS. 1 and 2 of the drawings disclose a curing unit generally designated by reference numeral 10. Curing unit 10 consists of an elongated, generally inverted U-shaped housing 12 that has a top wall 14 and side walls 16. An elongated, generally eliptical reflector 20 is located in the lower open end of housing 12 and cooperates therewith to define an elongated chamber 22. The outer surface 24 of reflector shield 20 is spaced from the adjacent lower edge of housing 12 to define elongated slots 26, for a purpose that will be described later.

A conventional ultraviolet lamp or tube, such as a mercury vapor tube, 28 is located within reflector 20.

In practice, an article having a coating of ink or other material therein is supported on a porous conveyor belt 30 moving in the direction indicated by the arrow 32 to pass below the lower open end of the chamber and reflector while ultraviolet light is being produced by the lamp 28 to cure a previously-applied imprint on the article.

In most conventional types of curing units, a significant amount of heat is developed within the chamber and the temperature easily becomes excessive, which may damage the article, particularly when it is a heat-sensitive material. Numerous methods have been proposed for cooling the curing unit utilizing a combination of air and water, such as, for example, placing water jackets around the outer surface 24 of reflector 20 to draw the heat from the reflector into the cool water. However, most of the units used or produced require a large unit that will allow for dissipation of the heat developed inside the unit.

According to the present invention, the curing unit 10 incorporates a unique cooling system that effectively wipes the metal surfaces that would normally retain the most heat to maintain the system at an acceptable operating temperature at all times. More specifically, the cooling system operates such that it directs cooling fluid to both the inner and outer surfaces of the reflector at all times.

The cooling system includes blower means 40 supported on top of upper wall 14 of housing 12 for directing air into chamber 22. In the specific embodiment illustrated, the blower means is in the form of three spaced fans 42, each of which directs cooling fluid, such as air, into the chamber 22 to flow along the outer surface 24 of reflector shield 20.

According to the primary aspect of the present invention, the cooling means also includes deflector means for deflecting at least some of the cooling fluid to flow along the inner surface of the reflector shield to prevent heat build-up along the surface. As illustrated in FIG. 2, deflector means is in the form of an extension 44 extending from the leading lateral edge 46 of housing 12 downwardly below the lower leading lateral edge 48 of the reflector shield. Extension 44 has a substantially C-shaped end portion 50 that extends around lateral edge 48 so that the cooling fluid flow through slot 26 adjacent leading edge 46 of housing 12 is directed around lateral edge 48 and upwardly along the inner surface 52 of reflector shield 20.

The deflector 50 is designed such that the cooling fluid flowing along the inner surface 52 of reflector shield 20 does not impinge directly upon the ultraviolet light source 28 so that the efficiency of the unit is increased. The cooling fluid flowing along inner surface 52 is also directed downwardly at the trailing edge of reflector shield 20 toward an article on belt 30 to partially cool the article as it is exiting from the curing unit. This novel method of cooling substantially reduces the amount of cooling space necessary for operating at a temperature level necessary when working with heat-sensitive fabrics.

One of the other problems inherent in an ultraviolet light curing unit of the type envisioned herein is the fact that the system output is ultraviolet light rays, as well as ozone which is generated by the light source and is preferably not exhausted to the surrounding atmosphere to prevent exposure to humans operating the system.

According to another aspect of the invention, the curing apparatus 10 also incorporates baffle means adjacent the entrance and exit of the unit to prevent any light from being reflected outside of the unit. The baffle means is illustrated in FIG. 2 and includes an extension 60 extending from the lower edges 46 of housing 12, being connected by a hinge structure 62. The baffle means 64 extends laterally from the lower edge of extension 60 and is designed to allow air to pass therethrough while preventing any light from being reflected directly from the conveyor 30. As shown, the baffle means 64 is in the form of overlapping V-shaped elements or chevrons 66 that cooperate to define a continous surface preventing reflection of light therethrough while being spaced from each other to accommodate air flow. A plate or element 70 extends from baffle means 64 along the leading edge of the curing unit to define a small entrance space 72 between the top surface of conveyor belt 30 and the lower edge of extension 70. Also, the baffle means adjacent the trailing end of the curing unit may have a wiper element 74 secured thereto and designed to engage the top surface of belt 30 and define a closed chamber between the baffle means 64 and belt 30.

The chevron structure of the baffle means 64 creates a condition such that any ultraviolet light rays that enter therein bounce back and forth until extinguished without being allowed to pass through the baffle means.

According to another aspect of the invention, the ozone that is normally generated within the system is automatically withdrawn and prevented from exiting into the surrounding atmosphere. For this purpose, a vacuum chamber 80 having a porous upper surface 82 is located below the belt 30 and has a vacuum source 84 connected thereto. Thus, any ozone that is generated under reflector 20 is drawn into the vacuum chamber 80. The vacuum chamber also aids in holding the article on the surface of the belt.

The upper surface 82 may be configured in the same manner as the baffle means 64 to reflect any ultraviolet light rays while allowing air and ozone within the air to be drawn therethrough.

The system is also designed to minimize the energy consumption. According to another aspect of the invention, the system incorporates sensor means for sensing the presence and absence of an article to be cured and controls the output of lamp 28 in response thereto. As illustrated in FIG. 2, the sensor means is in the form of a photocell 90 located below belt 30 and a receiver unit 92 located above belt 30. When an article is present on the belt and passes between receiver 92 and photocell 90, the lamp is activated to the desired lamp wattage output until such time as the trailing edge of the article passes across the receiver unit whereupon the lamp is deactivated. If desired, the lamp wattage could be operating continuously at a low output and increased significantly when an article is present. Of course, suitable time delays are incorporated into the control system to delay the signal until the article is physically under the reflector 20.

As can be appreciated from the above description, the present invention provides a unique compact modular unit that can easily be installed in a confined space and will prevent any harmful ozone or ultraviolet light from exiting from the system. The cooling of the system is such that surfaces of the reflector which absorbs most of the heat from the reflecting light rays is cooled at all times thereby producing a lower operating temperature while still allowing the lamp to be at the preferred temperature of 1200°-1300° F. The hinged extensions 60 allow for easy access to the lamp for maintenance and replacement.

We claim:

1. A method of curing ink, or the like, on a moving piece of work moving through a curing station having an arcuate reflecting shield facing downwardly and covering an elongated curing lamp and a blower means for blowing air for cooling, and exhaust means for pulling air from the unit, said method comprising the steps of:

directing cooling fluid from the blower means downwardly along the upper and outer surface of the arcuate reflector shield to cool the same, directing cooling air upwardly and inwardly along the inner surface of the reflector shield to wipe the same with air to cool the same, directing radiation from the lamp onto a work moving under the lamp and reflector shield, trapping radiation with baffles at the upstream entrance and downsteam exit of the work on the conveyor, flowing air through the baffles, and pulling air downwardly across the work and through the conveyor and exhausting the same from the unit.

2. A method of curing ink or the like, on a traveling piece of work traveling generally horizontally on a conveyor through a curing station having an arcuate reflecting shield facing downwardly and covering an elongated curing lamp which emits radiation toward the work and a blower means for blowing air, said method comprising the steps of:

traveling the work along a conveyor from inlet to outlet side of the unit, directing cooling air downwardly along an upper and outer surface of the arcuate reflector shield to cool the same, redirecting air flowing downwardly past a lateral lower edge of the reflector shield to turn upwardly and inwardly along the inner surface of the reflector shield to wipe the same with air to cool the same, emitting radiation downwardly toward the work being carried beneath the curing lamp, trapping light at the forward and rearward edges of the housing adjacent the conveyor means, pulling air downwardly across the work and conveyor means and exhausting the air from below the conveyor and work to withdraw heat and ozone from the unit.

3. A curing unit for curing ink or other material on a piece of work traveling through the unit, said unit comprising:

an elongated curing lamp for directing radiation at the work traveling therepast, a reflector shield partially surrounding the lamp with the lamp being positioned adjacent and spaced from an interior surface of the reflective shield and located at a central portion of the reflector shield, the reflector shield having side sections extending from the central section and terminating in lateral edges facing the work;

a housing about the outer side of the reflector shield and spaced therefrom and extending toward the work, cooling means including blower means for producing cooling fluid and for directing the cooling fluid into the housing and for flowing the same across the outside surface of the reflector shield and for flowing along toward the lateral edges of the reflector shield, means comprising a deflector means adjacent one edge of the reflector shield for directing cooling fluid to flow along the interior surface of the reflector shield to remove heat therefrom and to cool the same, and means for pulling the cooling fluid across the workpiece and for exhausting the cooling fluid from the unit.

4. A curing unit in accordance with claim 3 in which the deflector means includes a first portion located adjacent the outer side of one lateral edge of the reflector shield and forming a slot therewith and a curved section extending about the lateral edge to the inside of the reflector shield for directing the air to take a curved path from around the outer surface about the lateral edge and into a reverse direction parallel path along the inside surface of the reflector shield and toward the space between the lamp and the central portion of the reflector.

5. An apparatus in accordance with claim 3 in which the reflector shield is an arcuate member opening downwardly with the lamp being located adjacent the central section of the arcuate member, and the housing is an inverted U-shaped member located upwardly of and spaced from the arcuate reflector shield member, and in which an upstream and downstream light baffle projects laterally of the opposite sides of the housing, said baffles being opened to atmosphere to allow air flow therethrough as well as to trap light.

6. An elongated curing unit for extending transversely across a conveyor for carrying a work along a path through the unit, said unit comprising:

curing lamp means for directing radiation at the work traveling therepast on the conveyor, a downwardly opening reflector shield partially surrounding the lamp with the lamp being positioned adjacent and spaced from an interior surface of the reflective shield and located at central portion of the reflector shield, the reflector shield having lower side sections extending from the central section and terminating in lateral edges spaced adjacent and above the work;

an elongated housing extending across the path of the work with a top wall and side walls partially surrounding the reflector shield on the outer side thereof, blower means for producing cooling fluid and for blowing cooling fluid down onto the top outside surface of the reflector shield and for flowing the cooling fluid downwardly toward the lateral edges of the reflector shield, means for directing cooling fluid along the inner surface of the reflector shield to cool the same, light baffles extending from the housing in opposite directions along the conveyor to trap light, said light baffles being pervious to air flow therethrough, and air exhaust means located below the workpiece and the housing and reflector shield for drawing the cooling fluid downwardly past the work and the conveyor and for exhausting the same from the unit.

7. A unit in accordance with claim 6 in which the light baffles include parallel plates inclined to the vertical in a chevron manner.

8. An apparatus in accordance with claim 6 in which at least one of baffles is hingedly connected to the housing to swing to expose the interior of the housing.

9. An apparatus in accordance with claim 7 in which the means for directing cooling fluid along the interior surface of the reflector shield comprises a deflector means having surfaces for directing cooling fluid flowing down past one edge of the reflector shield to turn and to flow upwardly along the interior surface of the reflector shield.

10. A method in accordance with claim 9 in which the step of redirecting the cooling air is at the upstream side of travel of the work and including the step allowing air to flow through the light baffles to aid in cooling the unit.

11. An elongated curing unit for extending transversely across a conveyor carrying a work along a path through the unit, said unit comprising:

curing lamp means for directing radiation at the work traveling therepast on the conveyor, a reflector shield partially surrounding the lamp with the lamp being positioned adjacent and spaced from an interior surface of the reflective shield and located at a central portion of the reflector shield, the reflector shield having side sections extending from the central section and terminating in lateral edges spaced adjacent the work;

an elongated housing extending across the path of the work with a top wall and side walls partially surrounding the reflector shield on the outer side thereof, blower means for producing cooling fluid and for blowing cooling fluid along the outer surface of the reflector shield and for flowing the cooling fluid toward the lateral edges of the reflector shield, light baffles extending from the housing in opposite directions along the conveyor to trap light, said light baffles including a plurality of parallel plates arranged in a chevron manner and being pervious to air flow therethrough, and air exhaust means located on the opposite side of the workpiece from the housing and reflector shield for drawing the cooling fluid across the work and the conveyor and for exhausting the same from the unit.

* * * * *